US006973859B2

(12) United States Patent
Noniewicz

(10) Patent No.: US 6,973,859 B2
(45) Date of Patent: Dec. 13, 2005

(54) CLAMPING OR EXPANDING PLIERS

(75) Inventor: Zbigniew Noniewicz, Kempenich (DE)

(73) Assignee: wolfcraft GmbH, Kempenich (DE)

( * ) Notice: Subject to any disclaimer, the term of this patent is extended or adjusted under 35 U.S.C. 154(b) by 0 days.

(21) Appl. No.: 10/480,578

(22) PCT Filed: Jun. 10, 2002

(86) PCT No.: PCT/EP02/06331

§ 371 (c)(1),
(2), (4) Date: Aug. 18, 2004

(87) PCT Pub. No.: WO02/102553

PCT Pub. Date: Dec. 27, 2002

(65) Prior Publication Data

US 2004/0255730 A1 Dec. 23, 2004

(30) Foreign Application Priority Data

Jun. 16, 2001 (DE) ..... 101 29 130

(51) Int. Cl.[7] ..... B25B 7/14

(52) U.S. Cl. ..... 81/320; 81/318; 81/324; 269/3

(58) Field of Search ..... 81/320, 318, 324, 81/325, 328; 269/3, 6, 29, 268, 278

(56) References Cited

U.S. PATENT DOCUMENTS 5,041,028 A 8/1991 Stähle
5,842,371 A * 12/1998 Liaw ..... 72/409.12
6,116,124 A * 9/2000 Ping ..... 81/385
6,564,703 B1 * 5/2003 Lin ..... 100/234
D491,433 S * 6/2004 Noniewicz ..... D8/52

FOREIGN PATENT DOCUMENTS

DE 199 33 033 A1 8/2000
WO WO 00/47371 8/2000

* cited by examiner

*Primary Examiner*—Lee D. Wilson
*Assistant Examiner*—Alvin J Grant
(74) *Attorney, Agent, or Firm*—Everest Intellectual Property Law Group

(57) ABSTRACT

Locking or expanding pliers (1) having two plier arms (4, 5) which arc joined to each other in the manner of a scissor-type joint. The arms forming grip sections (6, 7) on one end and clamping sections (12, 13) on the other end and being able to be locked in various clamping positions, whereby the clamping results from the elastic deformation of at least one of the two plier arms (4, 5) occurring when the plier arms (4, 5) are placed in a clamping position. A spring element (F) is arranged in the active area between the clamping section and the grip section in order to achieve improved proportioning of the clamping force, whereby both grip sections (6, 7) can be disposed on top of each other and placed in another locking position (19, 20), when both clamping sections (12, 13) are maintained in a distanced position (a), in order to increase clamping power.

14 Claims, 2 Drawing Sheets

CLAMPING OR EXPANDING PLIERS

CROSS-REFERENCE TO RELATED APPLICATION

This patent application claims priority of German patent application no. 10129130.2 filed Jun. 16, 2001 which is incorporated herein by reference.

BACKGROUND OF THE INVENTION

The invention relates to clamping or expanding pliers having two pliers arms which are connected to one another in the manner of a scissors joint, which form handle sections at one end and clamping sections at the other end and which can be latched in different clamping positions, the clamping force being the result of elastic deformation of at least one of the pliers arms, this deformation being associated with the movement of the pliers arms into the clamping position.

Clamping or expanding pliers of this type are known from DE-A 199 33 033. For stress-relieving return deformation which eliminates the clamping action, the spring force, that is to say the restoring force of the pliers arms, is unblocked.

SUMMARY OF THE INVENTION

It can be an advantange of the invention, in clamping or expanding pliers, to improve the ability of the clamping force to be regulated.

This advantage can be achieved, in the case of clamping or expanding pliers having the features of claim 1, by a spring element which is disposed in the region of action between the clamping section and handle section such that, with the two clamping sections secured in a spaced-apart position in relation to one another, the two handle sections can be displaced toward one another into another latching position in order to increase the clamping force.

Such a configuration makes it possible to achieve clamping or expanding pliers of the with an increased utility value. For all practical purposes, the tool has two clamping centers, which, in terms of action, follow one after the other or coincide: the clamping center which is based on the resilience of the pliers arms and that of the associated spring element. This increases the size of the region applying the clamping force, which aids the desired ability to regulate this clamping force. This is because, beyond the normal clamping position, the handle sections can be drawn further toward one another, such that one or more additional latching steps are possible. The clamping action is optimized for all practical purposes. Nevertheless, the high-grade clamping position can easily be released again using the disengaging device which is described in detail in the abovementioned forerunner. The disclosure contents of the abovementioned DE-A 199 33 033 are hereby included in full, also for the purpose of incorporating features of these documents in claims of the present application. The spring element, which is incorporated in the region of action between the clamping section and handle section, is actually disposed on a handle section. It proves to be advantageous here for stabilizing purposes, in particular, if the pliers arms are formed by flexurally stiff profile bodies, in particular made of metal. It is further provided that one of the two pliers arms is formed by two levers which are resiliently mounted in relation to one another by the spring element. The levers retain the associated spring element in a protected manner between them, it being possible for the profile structure to be utilized to very good effect for the purpose of forming a spring chamber. The two legs can be pivoted toward one another about the pliers joint in order to increase the clamping force. A configuration which is advantageous in this respect consists, furthermore, in that one of the two levers is a two-armed output lever, which forms the clamping section with a first lever arm and, with its second lever arm, extends between the two handle sections, of which one handle section, as actuating arm of the drive lever formed by the other lever, acts on the second lever arm, with the interposed spring element being compressed in the process. The free interstice between the two handle sections of the pliers arms is used in a structurally advantageous manner here as an abutment. Activation takes place by way of the handle section of one plier leg which is disposed thereabove. In certain cases, it may be advantageous to prestress that spring element located between the two levers. The invention then proposes that the spring element is a compression spring and is associated with the plier arm which has a latching-release lever. In respect of the abovementioned prestressing, it proves to be advantageous if the plier arm which carries the latching-release lever is supported on the other plier arm via a nose which extends on the far side of the pliers joint. This results in effective expansion limiting. This can be utilized for fastening the spring element, and indeed in the sense of the prestressing indicated above. The invention then proposes that the pliers sections which form the pliers mouth are formed by groups of lamellae. This makes it possible to combine clamping sections with different powers of resistance and of different types. The lamellae are held together via fastening locations which are provided anyway on the handles, for example in the form of inserted rivets or the like. The handle sections of the pliers arms themselves are formed by cross-sectionally U-shaped profiles which have been produced by punching and bending, it being possible for at least one U-opening to also form the spring chamber for the spring element indicated above. A configuration of even independent importance, for clamping or expanding pliers in which the clamping sections have clamping jaws, consists in the U-shaped clamping jaws being folded from a punched blank, which has a window, such that the profiled window edges which are oriented toward one another form two gripping flanks which extend parallel to one another and are connected to one another at the ends via crosspieces. In the case of a desired articulated arrangement of such clamping jaws, the holes, which form corresponding bearing eyelets, are also provided during the punching operation. It is, of course, also possible to use wall offsets in the region of the bearing eyelets, this resulting there in a further folding-related stiffening effect by way of the corresponding polydirectionality. Otherwise, the clamping sections may also form, for example, pliers jaws, for example those of pointed pliers. Finally, it is also proposed that the latching-release lever is fixed in its basic position. To conclude, the structural procedure in this respect may be such that the fixing takes place by means of a slide which is associated with the handle section and can be introduced into the displacement path of the latching-release lever.

Additional features and advantages of the present invention are described in, and will be apparent from, the following Detailed Description of the Invention and the figures. The features and advantages may be desired, but, are not necessarily required to practice the present invention.

BRIEF DESCRIPTION OF THE FIGURES

The subject matter of the invention is explained in more detail hereinbelow with reference to an exemplary embodiment which is illustrated in the figures, in which.

DETAILED DESCRIPTION OF THE INVENTION

Figure 1:
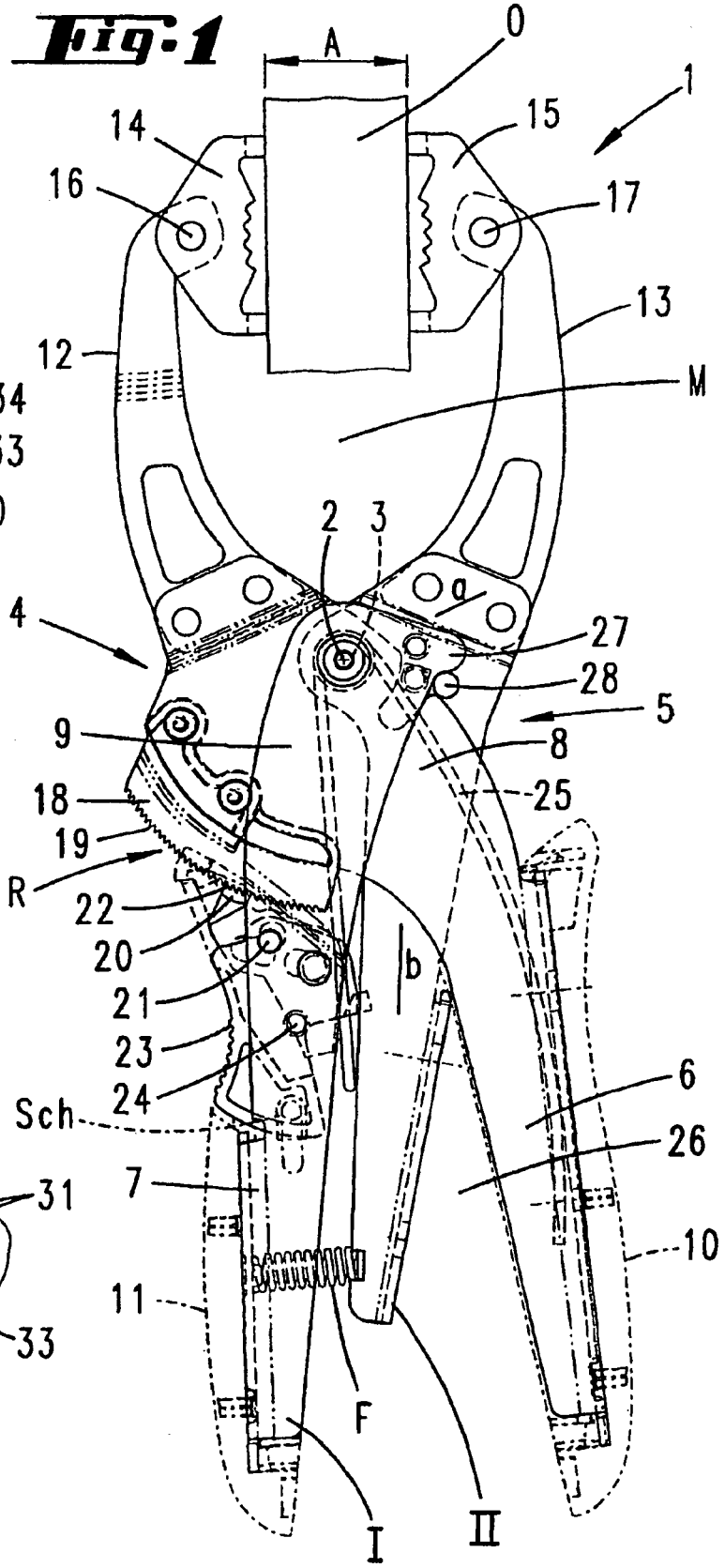
FIG. 1 shows, in side view, the clamping pliers according to the invention, to be precise with an object clamped therein.

The clamping pliers 1 illustrated is constructed in the manner of a scissors joint, although a so-called through-joint is formed here.

The joint is formed by a pin, which will be referred to throughout as pliers joint 2.

The pin of the pliers joint 2 passes through congruent eyelets 3 in the crossover region of two pliers arms 4, 5. The latter comprise flexurally rigid profile bodies made of metal. Profile bodies in the stricter sense here are those regions of the pliers arms 4, 5 which are remote from the pliers joint, and form handle sections 6, 7. These take up a good two thirds to a half of the length of the pliers arms 4, 5. The plier arm 5 exhibits the longer profiling.

The profiling is formed by U-shaped parts, as seen in cross section. The U-openings of the handle sections 6, 7, which diverge in the direction away from the pliers joint, are directed toward one another and are in the same plane, in relation to the pivoting plane of the pliers arms 5, 6 of the tool.

That end of the handle sections 6, 7 which is directed toward the pliers joint 2 merges into intersecting lobes 8, 9, which are formed by the U-legs of the profile bodies. The U-web of the profile bodies has a slight shallow curvature.

The handle-forming zone of the pliers arms 4, 5 has handle shells 10 and 11 attached and secured to it. These handle shells are represented by chain-dotted lines. They are roughened to give a good grip.

The plier arms 4, 5 comprise profiles which have been produced by punching and bending, use being made of sheet steel. Fastening locations for the handle shells 10, 11 are provided at the same time.

The pliers arms 4, 5 merge directly or indirectly into clamping sections 12, 13. The latter have a slightly convex curvature and comprise groups of lamellae (see group of layers shown by chain-dotted lines in FIG. 1, left-hand clamping section 12). Their free ends each carry a respective clamping jaw 14, 15. These are mounted in a pivotable manner. Respective bearing pins 16 and 17 are used for this purpose. These pins pass through congruent bearing eyelets of the clamping jaws 14, 15. In spite of the respective opening angle of the pliers mouth M, an object O which is to be clamped is always gripped appropriately over the abutment surfaces.

The pliers arms 4, 5 can be latched in different clamping positions. A pawl arrangement R is used for this purpose. This arrangement comprises a toothed segment 18 which is fixedly connected to the plier arm 4. A pawl 20, which is mounted on the other plier arm 5, engages in the sawtooth-like toothing formation 19 of this toothed segment. The pivot pin of the pawl is designated 21, and the mating toothing formation of the pawl is designated 22.

The toothing formation 19 runs over a circle-arc section with a radius point identical to the geometrical axis of the pliers joint 2.

The mating toothing formation 22 which, as a result of the sawtooth structure, engages with slight blocking action in the manner of an undercut can be disengaged with moderate force with the aid of a latching-release lever 23, which is associated with the pawl arrangement R. This latching-release lever is likewise mounted on the plier arm 5. Its pivot pin is designated 24. The actuating conditions here are such that the initial result is a releasing action which relieves the peak pressure of the clamping grip. By virtue of a second or subsequent actuating step on the latching-release lever 23, the clamping pliers 1 can be opened all the way, i.e. to the maximum mouth width. This takes place with the assistance of spring force, the latter being provided by an expanding spring 25. This spring is mounted on the pliers joint 2 and, by way of its legs acting on the handle sections 6, 7, correspondingly subjects the pliers arms 4 and 5 to loading. The legs are associated with the U-openings of the same. The leg which is directed toward the plier arm 5 functions, at the same time, as a spring which biases the latching-release lever 23 in the direction of its basic position.

Specific details of the pawl arrangement R, which is only indicated here, can be gathered from the literature reference cited in the introduction.

The clamping force which retains/grips the object O is the result of elastic deformation of at least one of the pliers arms 4 and 5, this deformation being associated with the movement of the pliers arms 4, 5 into the clamping position. The corresponding elasticity is present, in respect of both the clamping sections 12, 13 and, to a certain extent, of the handle sections 6 and 7, if a relatively large resistance is also set against the handle sections 6, 7 themselves, as a result of the partial rigidity provided.

In order to increase the clamping force, and also to allow it to be regulated, the tool, in the form of the metal locking clamp illustrated, is provided with a further source for the clamping force. This is embodied by the provision of a spring element F, which is incorporated in the region of action between the clamping section and handle section.

The corresponding arrangement is such that, with the two clamping sections 12, 13 secured and latched in a spaced-apart position A in relation to one another, the two handle sections 6, 7 can be displaced toward one another into another latching position in order to increase the clamping force, i.e. the pawl 20 can still be displaced on the toothing formation 19, in the counterclockwise direction, by one or two teeth. This results in the spring element F being compressed and, correspondingly, in an increase in the restoring force, which is converted into an even firmer clamping grip on the object O. The spaced-apart position A from the basic clamping grip illustrated in FIG. 1 has already been exceeded. The next stage has already taken effect, as can be gathered from the compression of the spring element F.

As can be gathered, the spring element F is disposed on a handle section of the clamping pliers 1.

The corresponding abutment for the spring element F is achieved, in particularly practical terms, by a two-part construction of the plier arm 5. This plier arm forms two levers, designated 1 and 11. The lever 11 projects into the interstice 26 which is present anyway in the region of the handle sections 6, 7.

The lever 1 is a constituent part, albeit a shortened one, of the plier arm 5. The second lever 11 here forms the extension for the clamping section 13 of the double-armed plier arm 5, this clamping section following on the far side of the pliers joint 2.

The two levers 1, 11 can be pivoted toward one another about the pliers joint 2, with compression of the spring element F, in order to increase the clamping force. The spring element F is expediently provided in a prestressed state. It is a helical compression spring. As is depicted, the latter may be wound cylindrically or else also in the form of a barrel and has one end spring turn located in the interior of the plier arm 5, which carries the disengaging lever 23, and its other end spring turn located in the interior of the likewise U-profiled lever 11, consisting of sheet steel.

The lever designated 11 is two-armed. It functions as an output lever, which forms the basis of, or helps form, the clamping section 13 with a first lever arm a and, with its second lever arm b, extends between the two handle sections 6, 7, of which one handle section 6, as actuating arm of the drive lever formed by the other lever 11, acts on the second lever arm, with the interposed spring element F being compressed in the process.

The two-part lever arm 5, which carries the latching-release lever 23, is supported on the plier arm 5, that is to say on itself, via a nose 27 which extends on the far side of the pliers joint 2. The stop means which is seated on the lever 11, for this purpose, in the joint region is designated 28. By virtue of the nose 27, the lever 1 is likewise double-armed. The shorter lever arm is the one which forms the nose 27. The arm divide is formed by the pliers joint 2, which carries the parts 1, 11 (5) and 4.

As far as using the helical compression spring as the spring element F is concerned, it should be pointed out that the spring is secured in position via means which grip its end turns. These means may be protuberances or else also window-like cut-outs in the U-legs of the handle sections 6, 7.

Figure 2:
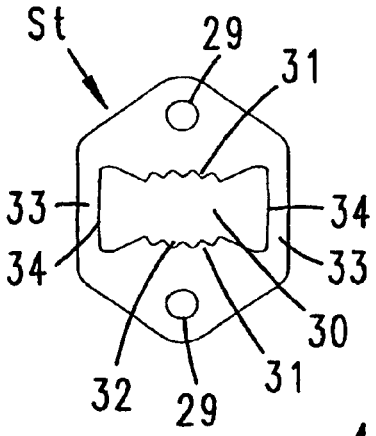
FIG. 2 shows, in plan view, the punched blank which can be folded to form a U-shaped clamping jaw.
Figure 3:
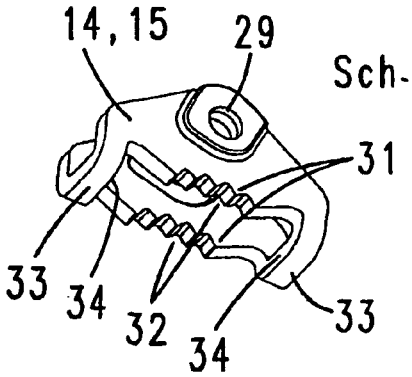
FIG. 3 shows, in perspective illustration, the punched blank, which has been folded to form a clamping jaw.

The illustrated U-profile clamping jaw 14, 15—the two being identical to one another—is produced from a punched blank St. Its interior and exterior outlines can be gathered from FIG. 2. The exterior one is approximately hexagonal. Holes for forming bearing eyelets 29 are provided in one longitudinal center plane of the punched blank St. The region of the transverse center plane, which is located symmetrically thereto, contains an elongate window 30. The punched blank St is folded such that the longer window edges 31 which are oriented toward one another form gripping flanks 32 which run parallel or—as is illustrated—in a concavely rounded manner in relation to one another. The resulting gripping structure is evident from FIG. 3.

The gripping flanks 32 are toothed in the central region. They may also be non-toothed and oriented along a circle-arc line, so that cylindrical objects O can be gripped to good effect without impressions being left behind on them.

The gripping flanks 32 are connected at the ends via crosspieces 33. The latter are considerably shorter edges 34 of the window 30.

By way of their planar-surface outer sides, the crosspieces 33 form a plane-parallel flat surface as a clamping surface which is utilized according to FIG. 1.

For the periods when they are not in use, the clamping pliers 1 can be kept in a space saving storage position (with the mouth M closed) using the pawl arrangement R explained above. In this case, the latching-release lever 23 is correspondingly fixed in its release position. As an alternative, it is possible for the fixing to take place by means of a slide Sch which is associated with the handle section 7 and can be introduced, with a blocking pin 35, into the displacement path of the latching-release lever 23. For this purpose, the latter has a blocking recess 36 which is open at the periphery.

Finally, the tool has an opening-limiting means 37, realized as a pin. The pin is seated on the lobe 9. Located in the pivoting region thereof is an arcuate slot, which is formed on the lobe 8. The arcuate slot runs concentrically in relation to the pliers joint 2. The base of the slot forms a stop. It is possible to provide a pair of opening-limiting means 37, i.e. one on both broad sides of the clamping pliers 1, with the lobes 8, 9 being fitted out or formed correspondingly.

The tool functions, in brief, as follows:

Once the object O has been gripped, the clamping pliers 1 is closed. This takes place forcefully via the handle sections 6, 7 being moved toward one another. The respective clamping position can be latched (19, 22). On the one hand, the clamping force is the result of elastic deformation of at least one of the two pliers arms 4, 5, this deformation being associated with the movement of the pliers arms 4, 5 into the clamping position. The restoring force of the pliers arms, in particular of the clamping sections 12, 13, has a sustained effect. Added to this is the clamping force of the spring element F. The greater the compression, the higher is the restoring fraction from this additional force zone. The clamping force from the spring element F acts, via the second lever 11 and the clamping section 13, on the clamping jaw 15 and against the object O, which is supported on the other clamping jaw 14.

Figure 4:
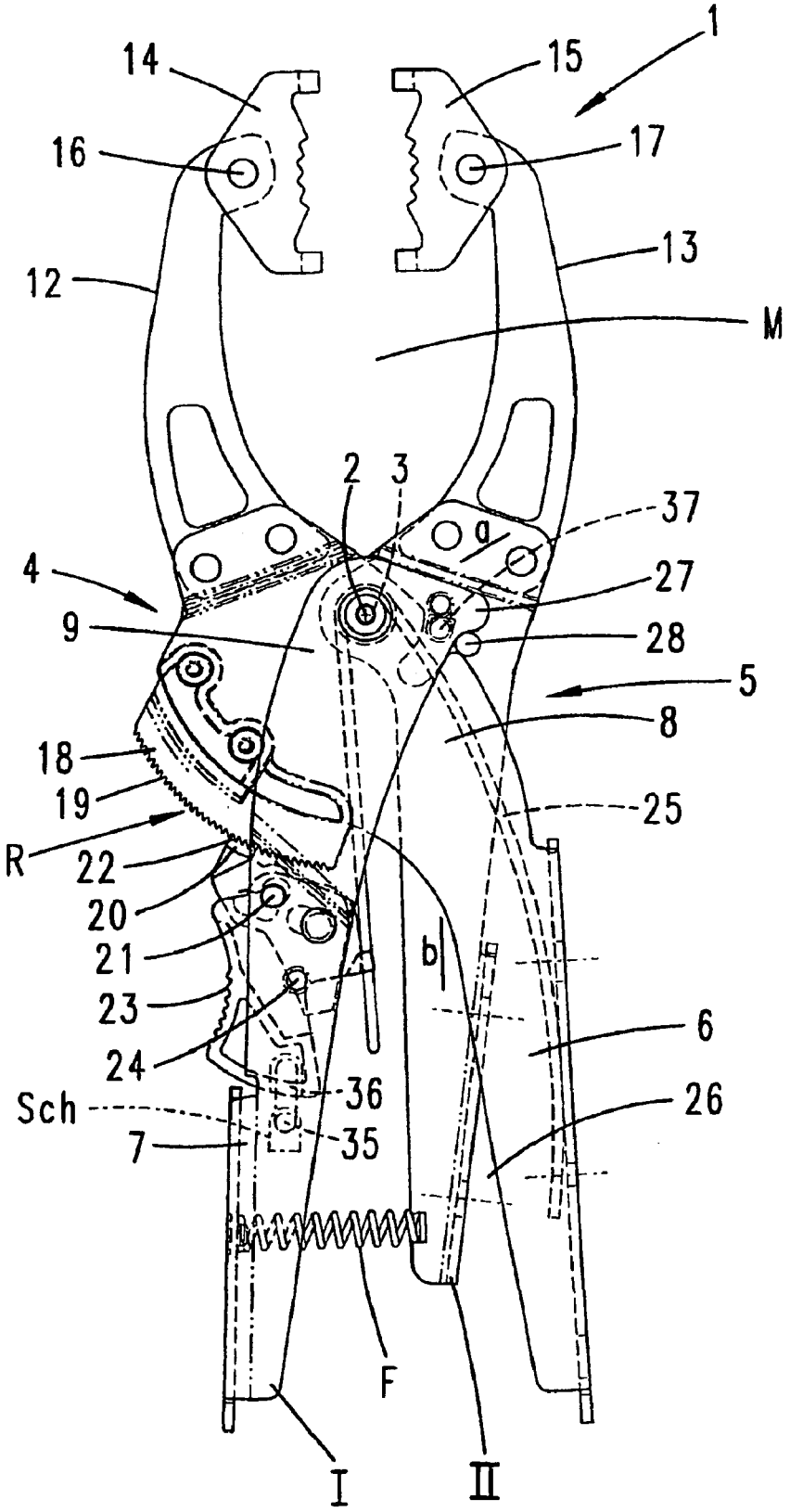
FIG. 4 shows an illustration corresponding to FIG. 1, but in an open position (without an object).

Release takes place with relatively low forces, by the actuation of the latching-release lever 23. In respect of the spring element, the tool then passes into the position according to FIG. 4, in which it is relieved of stressing.

All features disclosed are (in themselves) pertinent to the invention. The disclosure content of the associated/attached priority documents (copy of the prior application) is hereby also included in full in the disclosure of the application, also for the purpose of incorporating features of these documents in claims of the present application.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

What is claimed is:

1. A clamping or expanding pliers, comprising:

two pliers arms connected to one another at a pivot joint, and which form handle sections at one end and clamping sections at another other end, the two pliers arms being latchable at different clamping positions and having a clamping force from elastic deformation of at least one of the two pliers arms, the deformation being associated with movement of the two pliers arms into at least one of the clamping positions; and a spring element disposed in a region of action between the clamping sections and the handle sections such that, with the two clamping sections secured in a spaced-apart position in relation to one another, the two handle sections can be displaced toward one another into another latching position in order to increase the clamping force.

2. The clamping or expanding pliers according to claim 1, wherein the spring element is disposed on at least one of the handle sections.

3. The clamping or expanding pliers according to claim 1, wherein the two pliers arms are formed by flexurally stiff profile bodies made of metal.

4. The clamping or expanding pliers according to claim 1, wherein one of the two pliers arms is formed by two levers which are resiliently mounted in relation to one another by the spring element.

5. The clamping or expanding pliers according to claim 4, wherein the two levers can be pivoted toward one another about the pivot joint to increase the clamping force.

6. The clamping or expanding pliers according to claim 4, wherein one of the two levers is a two-armed output lever, which forms the clamping section with a first lever arm and, with a second lever arm extends between the two handle sections, of which one handle section, as actuating arm of the drive lever formed by the other lever, acts on the second lever arm, with the interposed spring element being compressed in the process.

7. The clamping or expanding pliers according to claim 4, wherein the spring element is disposed in a prestressed state between the two levers.

8. The clamping or expanding pliers according to claim 1, wherein the spring element is a compression spring and is carried by one of the two the pliers arms which has a latching-release lever.

9. The clamping or expanding pliers according to claim 8, wherein the pliers arm which carries the latching-release lever is supported on the pliers arm via a nose which extends on a far side of the pivot joint.

10. The clamping or expanding pliers according to claim 1, wherein the two clamping sections are formed by groups of lamellae and form a mouth of the pliers.

11. The clamping or expanding pliers according to claim 1, wherein the handle sections of the two pliers arms have cross-sectionally U-shaped profiles.

12. The clamping or expanding pliers according to claim 1, wherein the clamping sections have U-shaped clamping jaws formed by folding a punched blank, which has a window, such that the window has profiled window edges which are oriented toward one another and form two gripping flanks which extend parallel to one another and are connected to one another at ends via crosspieces.

13. The clamping or expanding pliers according to claim 1, further comprising a latching-release lever is fixed in a position on one of the two pliers arms.

14. The clamping or expanding pliers according to claim 13, wherein the latching-release lever is fixed in the position by a slide which is associated with one of the handle sections and which can be introduced into a displacement path of the latching-release lever.

* * * * *